US005786763A

United States Patent [19]

Canipe

[11] Patent Number: 5,786,763

[45] Date of Patent: Jul. 28, 1998

[54] ANTENNA MULTIPLEXER WITH ISOLATION OF SWITCHING ELEMENTS

[75] Inventor: Larry K. Canipe, Boca Raton, Fla.

[73] Assignee: Sensormatic Electronics Corporation, Boca Raton, Fla.

[21] Appl. No.: 667,811

[22] Filed: Jun. 20, 1996

[51] Int. Cl.[6] ..... G08B 13/14

[52] U.S. Cl. ..... 340/572; 343/876

[58] Field of Search ..... 340/572, 505, 340/825.54; 370/334; 455/101, 129; 343/876, 867, 855, 856, 852, 853; 333/131; 342/374; 307/17

[56] References Cited

U.S. PATENT DOCUMENTS

| | | | |
|---|---|---|---|
| 3,863,244 | 1/1975 | Lichtblau | 340/572 |
| 3,949,959 | 4/1976 | Rhoton et al. | 246/34 CT |
| 4,274,090 | 6/1981 | Cooper | 340/572 |
| 4,635,041 | 1/1987 | Maimann et al. | 340/572 |
| 4,652,861 | 3/1987 | Domes | 340/572 X |
| 4,679,046 | 7/1987 | Curtis et al. | 340/572 X |
| 4,700,179 | 10/1987 | Fancher | 340/572 |
| 4,872,018 | 10/1989 | Feltz et al. | 340/572 X |
| 5,257,010 | 10/1993 | Rehder | 340/572 |
| 5,373,301 | 12/1994 | Bowers et al. | 340/572 X |

OTHER PUBLICATIONS

Texas Instruments, *TIRIS Automatic Radio Frequency Identification System*, 1994.

*Primary Examiner*—Thomas J. Mullen, Jr.

*Attorney, Agent, or Firm*—Robin, Blecker & Daley

[57] ABSTRACT

A multiplexing arrangement for an electronic article surveillance and identification system interconnects a transmitter and a plurality of antennas. The transmitter has first and second terminals and each of the antennas includes an antenna coil. The multiplexing arrangement includes a step down transformer that has a primary winding connected across the first and second terminals of the transmitter, and also has a second winding. A first winding is positioned for inductively coupling with the antenna coil of a first antenna and a second winding is positioned for inductively coupling with the antenna coil of a second antenna. The multiplexing arrangement also includes a first switch and wiring that forms a series loop connection including the first winding, the second winding, the first switch and the secondary winding of the transformer. The first switch is arranged to selectively open-circuit the series loop connection. Also included in the multiplexing arrangement are a second switch connected across the second winding for selectively short-circuiting the second winding and a third switch connected across the first winding for selectively short-circuiting the first winding. The first, second and third switches may be implemented using MOSFETs that are completely isolated from the transmitter.

21 Claims, 6 Drawing Sheets

ANTENNA MULTIPLEXER WITH ISOLATION OF SWITCHING ELEMENTS

FIELD OF THE INVENTION

This invention is related to circuitry for multiplexing a transmitter signal among a plurality of antennas, and more particularly to an application of such circuitry in an electronic article surveillance and identification system.

BACKGROUND OF THE INVENTION

Copending U.S. patent application Ser. No. 08/437,946, filed on Jun. 19, 1995, which has a common inventor and a common assignee with the present application, discloses an asset tracking and control system that is operated to detect, in real time, the whereabouts within a building of individuals or articles which carry transponder devices. Tracking of individuals or articles, by means of attached transponders, is carried out by antenna configurations installed at selected portals throughout the building. A preferred antenna configuration disclosed in the '946 application includes four antennas, operated in time-division multiplexed fashion from a single transmitter.

A known antenna multiplexing arrangement suitable for application in the above-referenced asset tracking system is indicated generally by reference numeral 10 in FIG. 1. The arrangement 10 includes a transmit circuit 12 and antennas 14-1 and 14-2, interconnected by switching circuitry 16. The switching circuitry 16 includes a switch 18-1 positioned for selectively open-circuiting an LC loop formed by the transmit circuit 12 and the antenna 14-1, and a switch 18-2 for open-circuiting a respective LC loop formed by antenna 14-2 and the transmit circuit 12. (It is to be understood that FIG. 1 is a simplified diagram, omitting two of the four antennas that are normally driven by one transmitter.)

For the purposes of the asset identification, tracking and surveillance system of the referenced '946 patent application, high speed switching is required, so that the switches 18-1 and 18-2 are implemented using MOSFETs or other transistor switches, rather than mechanical relays.

This known switching arrangement suffers from a number of disadvantages. For example, the MOSFET switches have considerable on resistances, and produce substantial heat which can reduce the operating life of the equipment. Also, there are significant limitations on the maximum distance by which the antennas 14-1 and 14-2 may be separated from the transmit circuit 12. Even if expensive wiring using litz wire is used, the maximum separation is about 25 feet. Although additional transistor switches, indicated in phantom at 18'-1 and 18'-2, can be provided in parallel to reduce the on resistance, this approach increases the cost of the equipment and introduces added switch leakage which makes it difficult to completely turn off the antennas.

OBJECTS AND SUMMARY OF THE INVENTION

It is an object of the invention to provide an antenna multiplexing arrangement for an article surveillance system which operates with greater efficiency than existing multiplexer arrangements.

It is a further object of the invention to provide an antenna multiplexer arrangement in which switching losses are reduced.

It is still a further object of the invention to provide an antenna multiplexer arrangement which eliminates coupling between adjacent antennas.

According to a first aspect of the invention, there is provided a transmitter for an electronic article surveillance system, including transmit circuitry for generating a transmit signal, antenna circuitry for receiving the transmit signal generated by the transmit circuitry and for radiating the transmit signal into an interrogation zone as an interrogation signal, and connecting circuitry for transmitting the transmit signal from the transmit circuitry to the antenna circuitry, the connecting circuitry including first coupling circuitry for coupling the connecting circuitry to the transmit circuitry, and second coupling circuitry for coupling the connecting circuitry to the antenna circuitry, the first coupling circuitry having a first impedance and the second coupling circuitry having a second impedance that is matched to the first impedance.

Further in accordance with this aspect of the invention, the antenna circuitry may include a first antenna and a second antenna, and the connecting circuitry includes switching circuitry for selectively uncoupling at least one of the first and second antennas from the transmit circuitry. The first antenna may include a first antenna coil for radiating the transmit signal in the interrogation zone, the second antenna may include a second antenna coil for radiating the transmit signal in the interrogation zone, the second coupling circuitry of the connecting circuitry includes a first winding inductively coupled to the first antenna coil and a second winding inductively coupled to the second antenna coil, and the switch circuitry of the connecting circuitry includes a first switch connected across the first winding for selectively short-circuiting the first winding and a second switch connected across the second winding for selectively short-circuiting the second winding. Further, the first coupling circuitry may be a transformer having a primary winding and a secondary winding with the secondary winding having the above-mentioned first impedance. Furthermore, the second coupling circuitry may include a first transformer for coupling the connecting circuitry to the first antenna and a second transformer for coupling the connecting circuitry to the second antenna. In that case, the switch circuitry may include a first switch connected across a winding of the first transformer for selectively short-circuiting that winding of the first transformer, and a second switch connected across a winding of the second transformer for selectively short-circuiting that winding of the second transformer.

Further, the antenna circuitry may include third and fourth antennas in addition to the first and second antennas previously mentioned.

According to another aspect of the invention, there is provided apparatus for interconnecting a transmitter and a plurality of antennas, the transmitter having first and second terminals, the plurality of antennas having a first antenna having a first antenna coil and a second antenna having a second antenna coil. The apparatus includes a step-down transformer having a primary winding connected across the first and second terminals of the transmitter and a secondary winding, a first winding positioned for inductively coupling with the first antenna coil of the first antenna, a second winding positioned for inductively coupling with the second antenna coil of the second antenna, a first switch, wiring for forming a series loop connection which includes the first winding, the second winding, the first switch, and the secondary winding of the transformer, where the first switch is arranged to selectively open-circuit the series loop connection, a second switch connected across the second winding for selectively short-circuiting the second winding, and a third switch connected across the first winding for selectively short-circuiting the first winding. The apparatus may also include a third antenna having a third antenna coil, with a third winding positioned for inductively coupling with the third antenna coil of the third antenna, a fourth switch connected across the third winding for selectively short-circuiting the third winding, a fourth antenna having a fourth antenna coil, a fourth winding positioned for inductively coupling with the fourth antenna coil of the fourth antenna, and a fifth switch connected across the fourth winding for selectively short-circuiting the fourth winding. The third and fourth windings are connected to the secondary winding in a second series loop connection that is in parallel with the above-mentioned series loop connection, and a sixth switch is provided to selectively open-circuit the second series loop connection.

According to a further aspect of the invention, there is provided a method of selectively energizing one of a plurality of antennas to radiate a signal generated by a transmitter circuit, each of the plurality of antennas having a respective antenna coil, and the method including the steps of providing a plurality of windings connected in series, each of the windings corresponding to, and inductively coupled with, a respective one of the antenna coils, the series-connected windings being coupled to the transmitter circuit, and short-circuiting all but one of the windings to select for energizing the antenna coil corresponding to the winding that is not short-circuited.

According to yet another aspect of the invention, there is provided apparatus for interconnecting a transmitter and a plurality of antennas, the transmitter having first and second terminals, the plurality of antennas including a first antenna having a first antenna coil and a second antenna having a second antenna coil, the apparatus including a first winding positioned for inductively coupling with the first antenna coil of the first antenna, a second winding positioned for inductively coupling with the second antenna coil of the second antenna, a first switch, wiring for forming a series connection of the first winding, the second winding and the first switch, circuitry for coupling to the transmitter the series connection of the first winding, the second winding and the first switch, a second switch connected across the second winding for selectively short-circuiting the second winding, and a third switch connected across the first winding for selectively short-circuiting the first winding.

Further in accordance with the latter aspect of the invention, the coupling circuitry may include a transformer for stepping down a level of a signal output from the transmitter to form a signal to be applied across the series connection of the first winding, the second winding and the first switch.

According to still a further aspect of the invention, there is provided an antenna multiplexer for supplying a radio frequency signal to a selected one of a plurality of antennas, including a plurality of transistor switches, for selecting respective ones of said plurality of antennas and each having a gate terminal, circuitry for filtering the radio frequency signal to form a bias signal, and circuitry for selectively coupling the bias signal to the respective gate terminals of the transistor switches.

The plurality of transistor switches may include stacked pairs of FETs, each pair of FETs corresponding to a respective one of the antennas. The bias signal may be selectively coupled to each pair of FETs for de-selecting the antenna which corresponds to the respective pair of FETs. The coupling circuitry may include a plurality of opto-isolators, each for controlling coupling of the bias signal to a respective one of the pairs of FETs.

The foregoing and other objects, features and advantages of the invention will be further understood from the following detailed description of preferred embodiments and practices of the invention and from the drawings, wherein like reference numerals identify like components and parts throughout.

DESCRIPTION OF PREFERRED EMBODIMENTS AND PRACTICES

Figure 1:
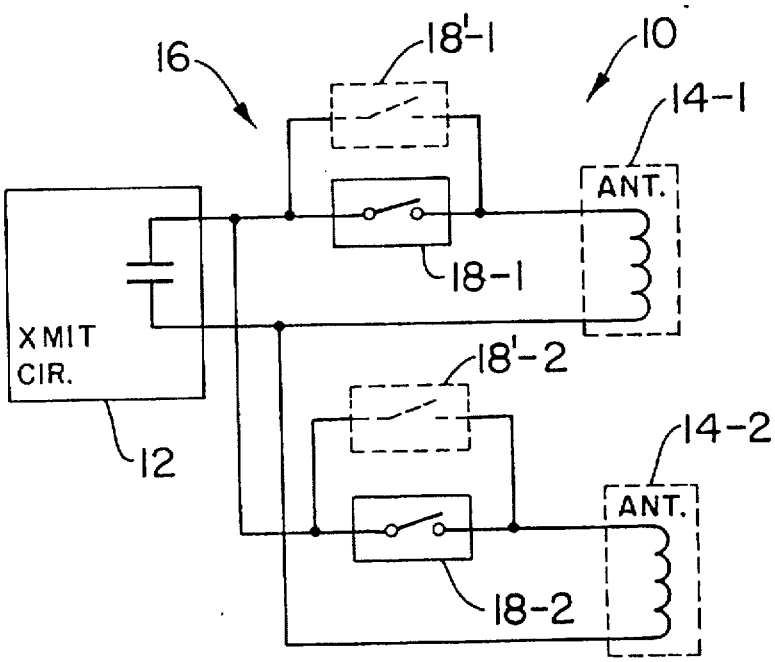
FIG. 1 (PRIOR ART)
FIG. 1 is a block diagram of a conventional antenna multiplexer arrangement.

Antenna multiplexer circuitry provided in accordance with a first embodiment of the invention will now be described with reference to FIG. 2. The arrangement of FIG. 2 includes a transmit circuit 12, which may be the same as the conventional transmit circuit described in connection with FIG. 1. The transmit circuit 12 includes first terminal 20 and a second terminal 22. The transmit circuit 12 may be of the type used in the TIRIS radio frequency identification system marketed by Texas Instruments. In the TIRIS system, the transmit circuit generates bursts at 134.2 kHz and the signal is transmitted through antennas to energize transponders that are attached to objects or individuals to be identified.

Figure 2:
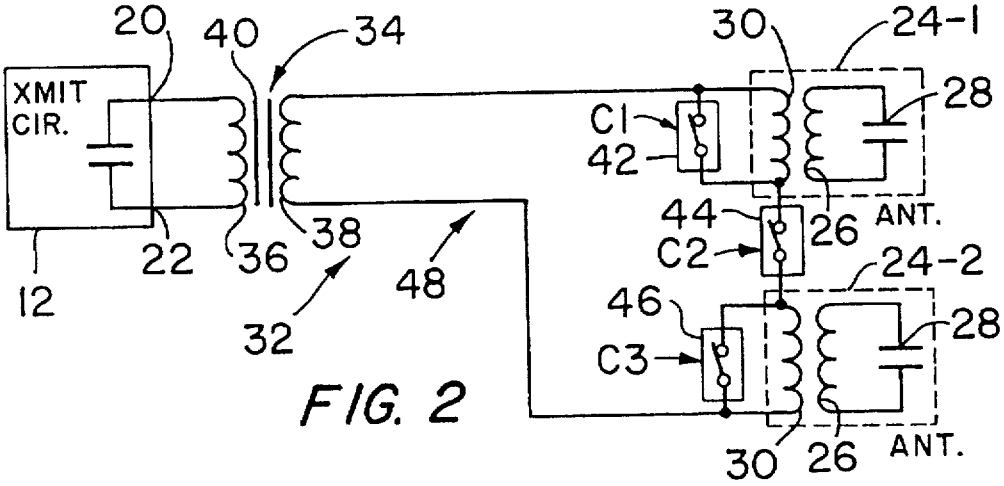
FIG. 2 is a block diagram of an antenna multiplexer arrangement provided in accordance with the invention.

The arrangement of FIG. 2 includes antennas 24-1 and 24-2. Each of the antennas includes an antenna coil 26 and a capacitance 28 connected across the coil 26 to form a resonant circuit with the coil 26. The antenna coil 26 is preferably formed as a planar, rectangular, air-core coil formed of three turns.

Each of the antennas includes a coupling winding 30 arranged in proximity to the antenna coil 26 for inductive coupling with the antenna coil 26. For example, the coupling winding 30 may be formed as a single turn adjacent to, in the plane of, and around the periphery of, the planar-rectangular antenna coil 26.

The coupling windings 30 of the antennas 24-1 and 24-2 are connected to the terminals 20 and 22 of the transmit circuit 12 by means of multiplexing and impedance-matching circuitry 32. The circuitry 32 includes a step-down transformer 34. The transformer 34 includes a primary winding 36 connected between the terminals 20 and 22 of the transmit circuit 12, and a secondary winding 38 inductively coupled to the primary winding 36 via a core 40.

Also included in the circuitry 32 are switches 42, 44 and 46. Wiring is provided to form a loop series connection 48 interconnecting in series the secondary winding 38 of the transformer 34, the respective coupling windings 30 of the antennas 24-1 and 24-2 and the switch 44. The switch 44 operates so as to selectively open-circuit the loop series connection 48. Although the switch 44 is shown in FIG. 2 as being connected between the respective coupling windings 30 of the antennas 24-1 and 24-2, the switch 44 may also be positioned at any other point in the loop series connection 48.

Switch 42 is connected across the coupling winding 30 of the antenna 24-1 so that the winding 30 of antenna 24-1 can be selectively short-circuited, and thus effectively removed from the loop connection 48. Similarly, switch 46 is connected across the winding 30 of the antenna 24-2 so that the winding 30 of the antenna 24-2 can be selectively short-circuited and thereby effectively removed from the loop 48. Control signals C1, C2 and C3 are respectively provided to the switches 42, 44 and 46 to switch the switches 42, 44 and 46 between open and closed states. The control signals C1, C2 and C3 are provided by a control circuit which is not shown.

The transformer 34 steps down the high voltage signal provided at the terminals of the transmit circuit 12, and the impedance of the secondary winding 38 of the transformer 34 is matched to the respective impedances of the windings 30 of the antennas 24-1 and 24-2. Consequently, current and voltage are in phase in the loop connection 48, and the current and voltage levels are relatively low in comparison with the high voltage and high current signals in the tuned circuits at the transmit circuit 12 and the antennas 24-1 and 24-2. The switches 42, 44 and 46 can therefore be implemented using relatively small, efficient and low cost solid state switches, thereby providing cost savings and improved power efficiency in comparison with the conventional multiplexing arrangement of FIG. 1.

When antenna 24-1 is to be selected for operation, switch 42 is opened and switches 44 and 46 are closed. As a result, the antenna coil 26 of antenna 24-1 is effectively coupled to the transmitter 12 and radiates the signal generated by the transmitter into the interrogation zone as a signal which interrogates any transponder present in the interrogation zone.

When antenna 24-2 is to be selected for operation, switch 46 is opened and switches 42 and 44 are closed, and the antenna coil 26 of antenna 24-2 is energized to radiate the interrogation signal. When switch 44 is opened, antennas 24-1 and 24-2 are both effectively disconnected from the transmit circuit 12.

Providing a short-circuit across the respective coupling winding 30 when an antenna is not selected for operation, prevents coupling between adjacent antennas, and crosstalk from the non-selected antenna.

Figure 3:
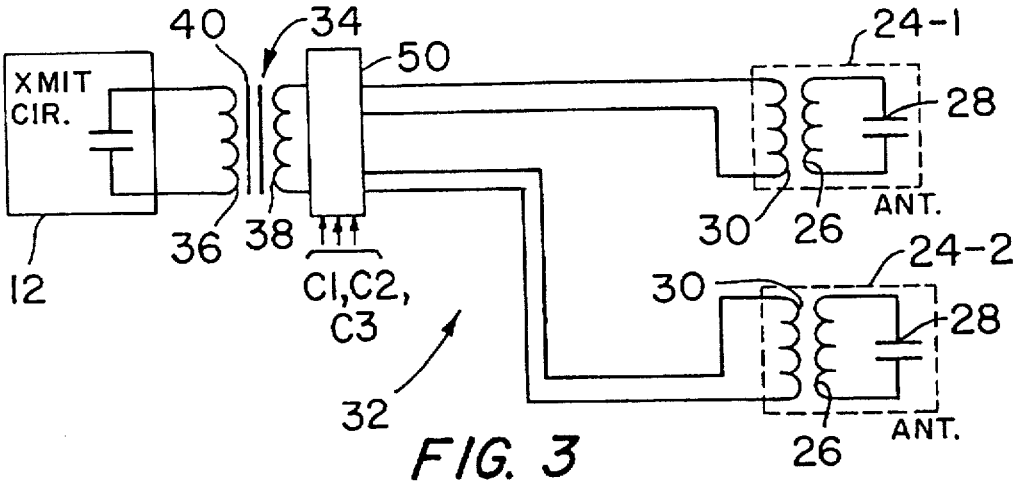
FIG. 3 is another block diagram representation of the multiplexer arrangement of FIG. 2, including a switching module provided adjacent to a transmit circuit.

FIG. 3 is another representation of the multiplexing arrangement of FIG. 2. In FIG. 3, the switches 42, 44 and 46 shown in FIG. 2 are represented by a switching module 50 provided between the transformer 34 and the antennas 24-1 and 24-2. As indicated in FIG. 3, the switching module 50 preferably is provided adjacent to the transformer 34, which, in turn, is preferably located close to the transmit circuit 12. In this way, the signal paths for the control signals C-1, C-2 and C-3 can be relatively short, it being assumed that the control circuit (which is not shown) for generating the control signals is located in proximity to the transmit circuit 12. On the other hand, because the switches incorporated in the switching module 50 are such as to provide rather low losses, the antennas 24-1 and 24-2 may be located at a considerable distance from the transmit circuit 12 and its associated transformer 34, and relatively inexpensive standard wiring can be used instead of the litz wire used in conventional installations.

Figure 4:
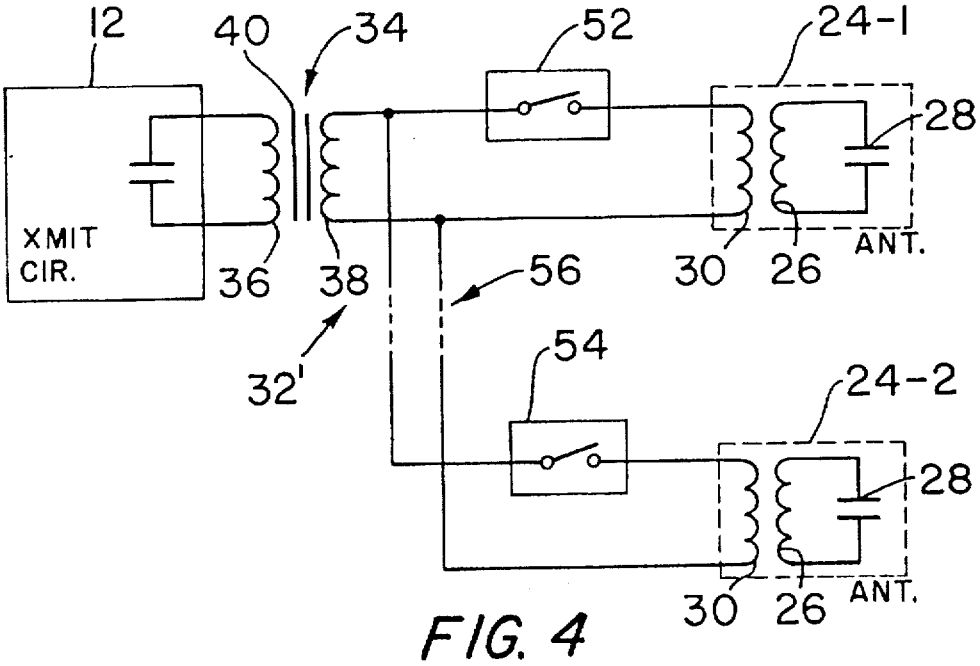
FIG. 4 is a block diagram of an antenna multiplexer arrangement provided in accordance with a second embodiment of the invention.

A second embodiment of the invention will now be described with reference to FIG. 4. The arrangement of FIG. 4 has the same transmit circuit 12, transformer 34 and antennas 24-1 and 24-2 as the arrangement of FIG. 2. However, the multiplexing and impedance-matching circuitry 32' of FIG. 4 is different from the circuitry 32 of FIG. 2, in that, in the FIG. 4 arrangement, antennas are de-selected by opening a switch provided in series with the respective coupling winding 30, rather than closing a switch connected across the coupling winding, as was done in the arrangement of FIG. 2. Specifically, the arrangement of FIG. 4 includes a switch 52 connected to selectively open-circuit a first loop formed of the secondary winding 38 of the transformer 34 and the coupling winding 30 of the antenna 24-1, and a switch 54 provided to selectively open-circuit a second loop which includes the secondary winding 38 and the respective coupling winding 30 of the antenna 24-2.

It will be understood that, when an antenna is not selected to transmit the interrogation signal, neither the antenna coil nor the coupling winding is short-circuited in the arrangement shown in FIG. 4. However, as is suggested by the ellipses 56 in FIG. 4, the antennas 24-1 and 24-2 are assumed to be at a considerable distance from each other, so that crosstalk and coupling between the two antennas is not a concern.

Figure 5:
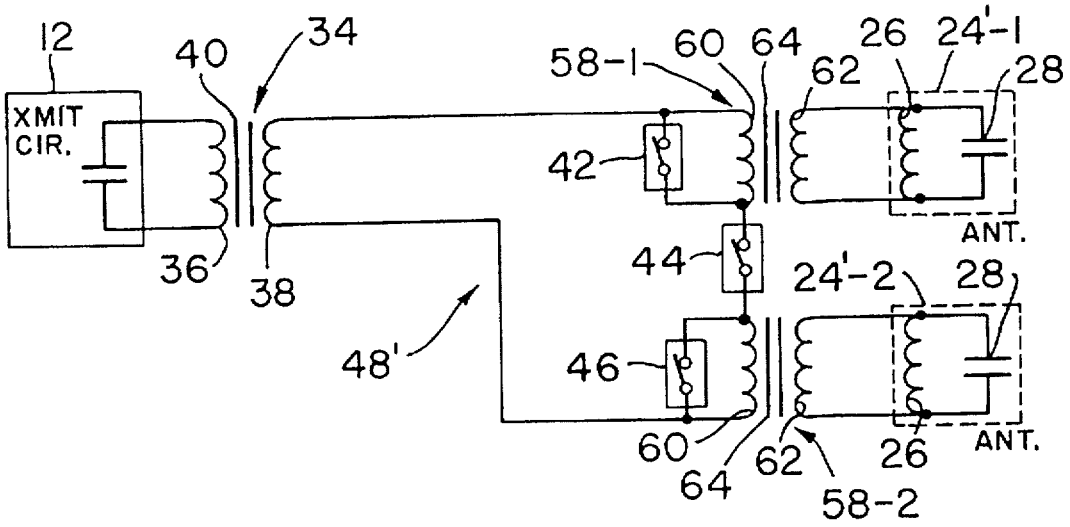
FIG. 5 is a block diagram of an antenna multiplexer arrangement provided in accordance with a third embodiment of the invention.

A third embodiment of the invention is illustrated in FIG. 5. The embodiment of FIG. 5 includes the same transmit circuit 12, transformer 34 and switches 42, 44 and 46 as the embodiment of FIG. 2. However, in the embodiment of FIG. 5, antennas 24'-1 and 24'-2 differ from the antennas shown in FIG. 2, in that the antennas of FIG. 5 do not include the coupling winding 30. Instead, the antenna coils 26 are coupled to the transmit circuit 12 by respective step-up transformers 58-1 and 58-2. Each of the step-up transformers includes a primary winding 60, a secondary winding 62 and a core 64 which inductively couples the windings of the step-up transformer. A series loop connection 48' is formed in the arrangement of FIG. 5, with the primary windings 60 of the transformers 58-1 and 58-2 taking the place of the coupling windings 30 shown in FIG. 2. Each of the secondary windings 62 is coupled to the antenna coil 26 of the respective antenna 24'-1 or 24'-2. The respective impedances of the primary windings 60 match the impedance of the secondary winding 38 of the transformer 34.

As in the arrangement of FIG. 2, the switches 42, 44 and 46 are in a relatively low current, low voltage loop and therefore may be smaller, more efficient, and less costly than transistor switches used in conventional antenna multiplexing arrangements. Also, as in the case of the embodiment of FIG. 2, non-selected antennas are effectively short-circuited (by the short-circuiting of the primary 60 of the corresponding transformer 58-1 or 58-2), so that crosstalk and coupling between the antennas is prevented.

Figure 6:
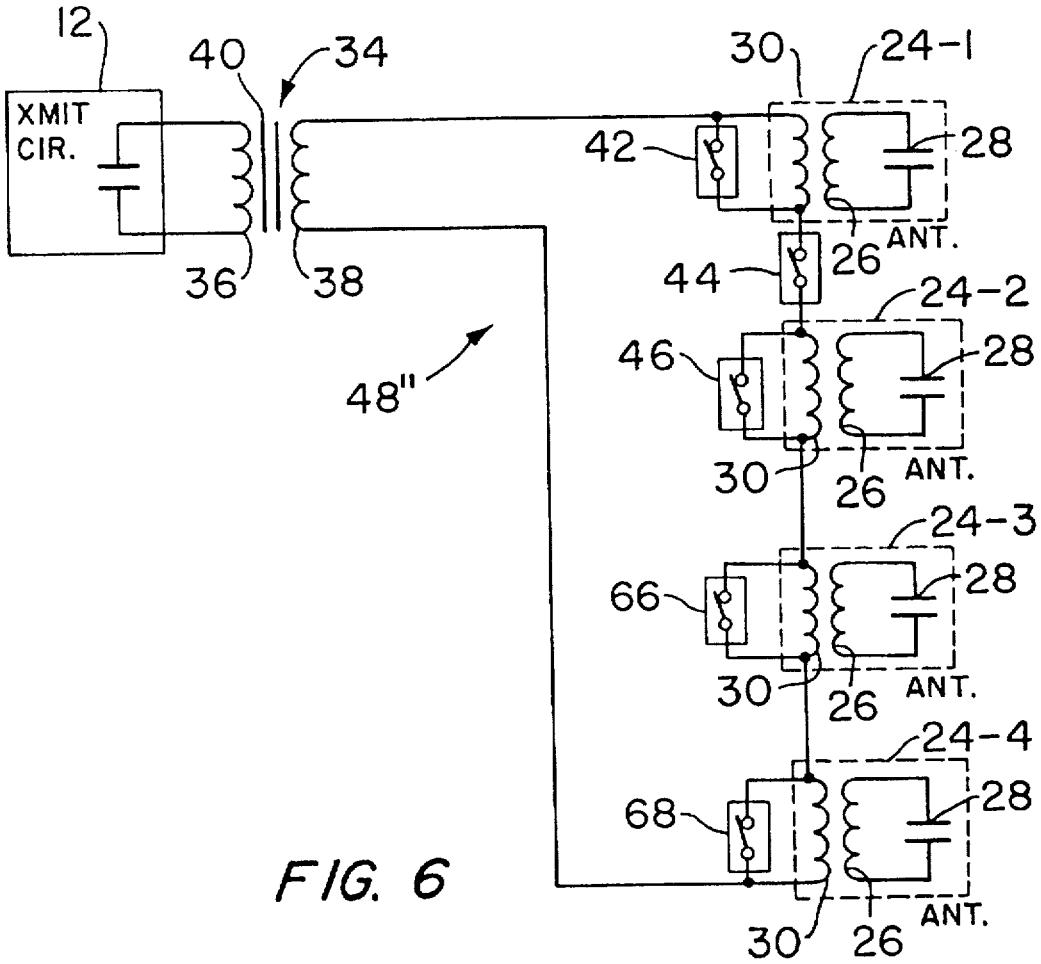
FIG. 6 is a block diagram of an antenna multiplexer arrangement provided in accordance with a fourth embodiment of the invention.

FIG. 6 illustrates a fourth embodiment of the invention. The embodiment of FIG. 6 is like that of FIG. 2, but with the addition of two more antennas (24-3 and 24-4), bringing the total number of antennas to four. It will be noted that, in the embodiment of FIG. 6, all four of the coupling windings 30 are in the same loop connection (indicated by 48" in FIG. 6), and that additional antenna selection switches 66 and 68 are provided, respectively connected across the coupling windings 30 of the antennas 24-3 and 24-4. When one of the antennas is selected to transmit the interrogation signal, the corresponding one of antenna selection switches 42, 46, 66 and 68 is opened, while all of the other antenna selection switches are closed, along with the loop switch 44.

Figure 6A:
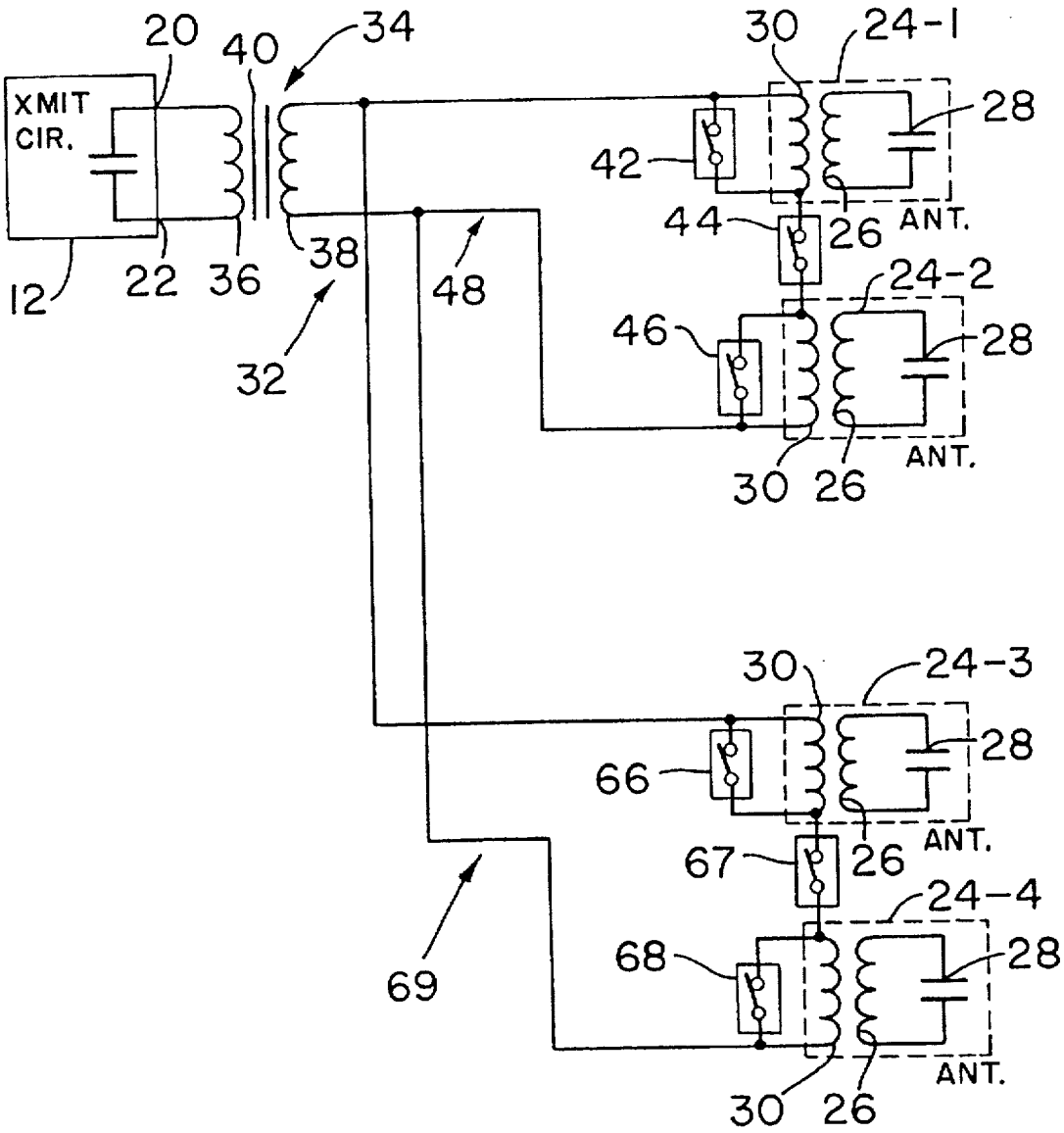
FIG. 6A is a block diagram of an antenna multiplexer arrangement provided in accordance with a fifth embodiment of the invention.

FIG. 6A illustrates a fifth embodiment of the invention. As in the embodiment of FIG. 6, four antennas are multiplexed, but two parallel loops, each for interfacing to two antennas, are provided instead of a single loop for interfacing to all four antennas. Specifically, in the fifth embodiment wiring is provided to form a loop series connection, indicated by reference numeral 69, among secondary winding 38 of the transformer 34 and the coupling windings 30 which respectively correspond to the antennas 24-3 and 24-4. A switch 67 is provided to selectively open-circuit the loop connection 69. The loop connection 69 is in parallel with the loop connection 48, which is the same as in the embodiment of FIG. 2.

Figure 7:
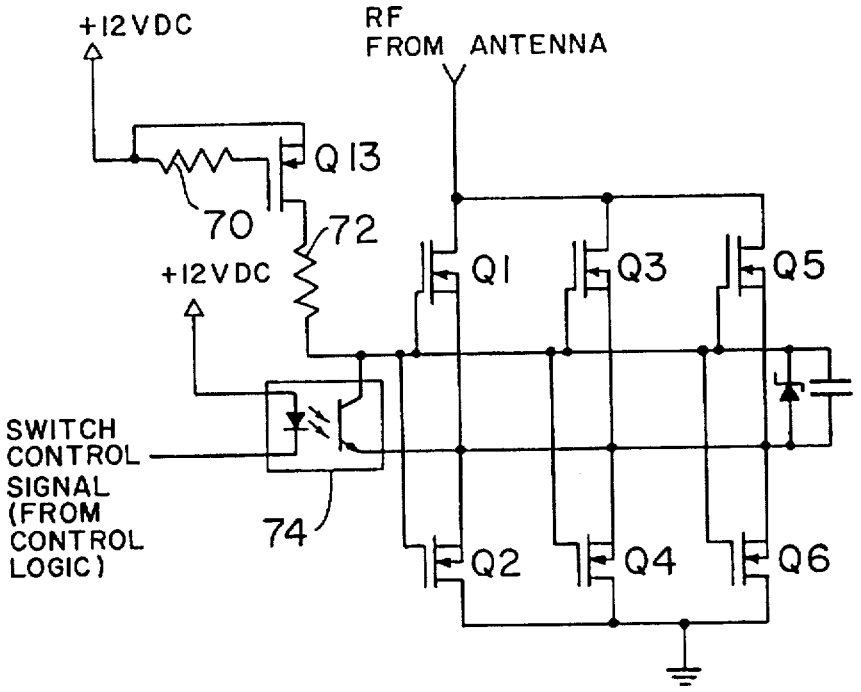
FIG. 7 (PRIOR ART)
FIG. 7 is a schematic illustration of a conventional switch control technique.

According to another aspect of the invention, an advantageous technique for coupling control signals to the antenna selection switches is provided. Before this technique is described, a prior art control signal coupling technique will be discussed with reference to FIG. 7. According to the known control technique, three stacked pairs of MOSFETs (Q1 and Q2; Q3 and Q4; Q5 and Q6) are provided in parallel in the path to ground from the antenna to be controlled by the parallel switches. As indicated in the earlier discussion of FIG. 1, the parallel switching pairs are provided to reduce the on resistance. A gate biasing signal for the switching transmitters is taken from the system 12-volt power supply through MOSFET Q13 and associated resistors 70 and 72. An opto-isolator 74 is driven by a switch control signal to selectively short the gate biasing signal to the source side of the switching transistors, thereby disabling the switching transistors and de-selecting the antenna controlled by the switching transistors.

In the switch control technique provided in accordance with the present invention, the bias signal applied to the gate terminals of the switching transistors is derived from the RF signal to be supplied to the antennas, and not from the system power supply. This allows a reduction in component count, while permitting complete isolation of the switching circuitry from the balance of the system. This technique takes advantage of the fact that a reduced number of switching transistors, suitable for low current applications, is used in the antenna multiplexing arrangements described in connection with FIGS. 2–6.

Details of this advantageous switch control practice will now be described with reference to FIG. 8.

Figure 8A:
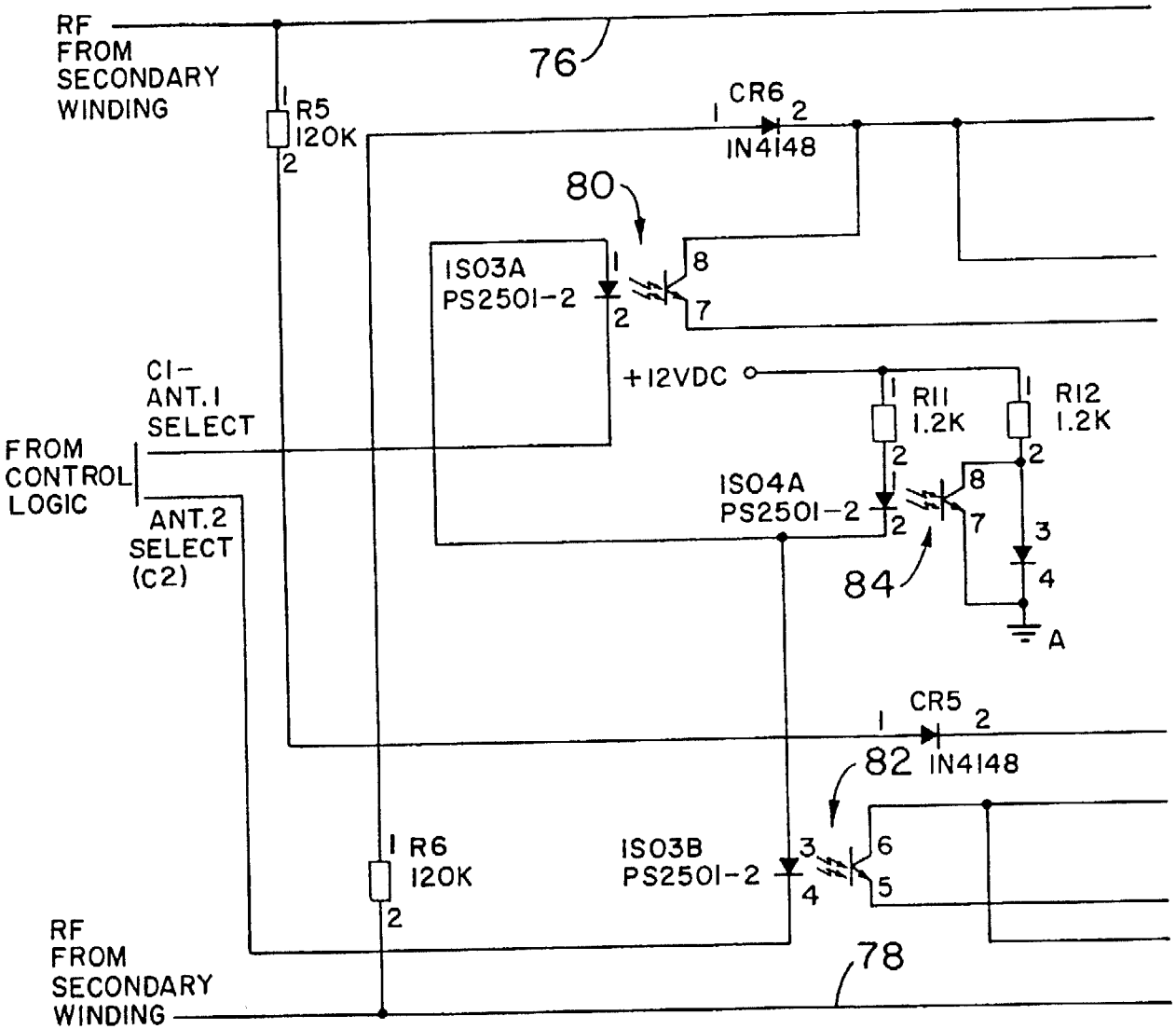
FIG. 8 is a schematic illustration of switch control circuitry provided in accordance with the present invention.
Figure 8B:
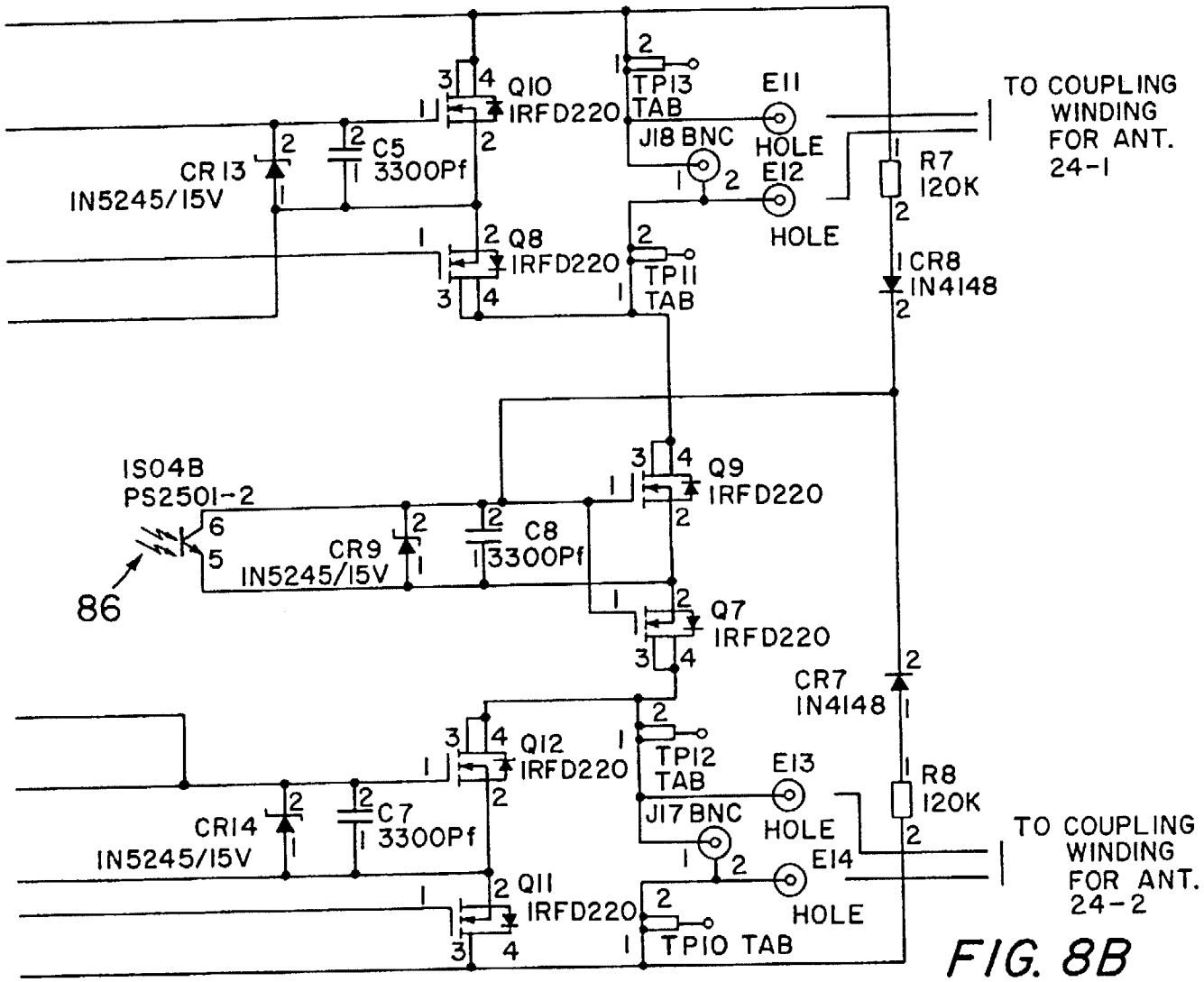

The circuitry shown in FIG. 8 includes dual RF buses 76 and 78 for transmitting the RF antenna driving signal from the secondary winding 38 (FIG. 2). Continuing to refer to FIG. 8, a stacked pair of MOSFETs Q8 and Q10 correspond to the switch 42 of FIG. 2, and a stacked pair of MOSFETs Q11 and Q12 correspond to the switch 46 of FIG. 2. The loop switch 44 of FIG. 2 is represented by the MOSFETs Q7 and Q9 in FIG. 8. Terminals E11 and E12 are provided to connect the circuitry of FIG. 8 to the coupling winding 30 of antenna 24-1 and terminals E13 and E14 are provided to connect the circuitry of FIG. 8 to the coupling winding 30 of antenna 24-2. The bias signal to be selectively provided to the gate terminals of MOSFETs Q8 and Q10 is derived from the RF signal on bus 78 by a filter network made up of resistor R6, diode CR6, zener CR13 and capacitor C6.

To select antenna 24-1 for transmission of the interrogation signal, an antenna select signal (corresponding to control signal C-1, FIG. 2, and provided by control logic which is not shown) actuates opto-isolator 80, which causes the filtered RF signal to be shorted to the common source connection of the MOSFETs Q8 and Q10, thus disabling the MOSFETs and eliminating the short-circuit connection which, when the MOSFETs are operative, removes antenna 24-1 from effective connection to the transmitter. For the MOSFET pair Q11 and Q12, which control connection to the antenna 24-2, a similar RF signal filter network is provided, made up of resistor R5, diode CR5, zener CR14 and capacitor C7. In similar manner to the above-noted operation of the switches controlling antenna 24-1, the MOSFETs 11 and 12 are selectively disabled by application of a control signal C2 applied to opto-isolator 82.

It will be observed that the signal selectively supplied to the gate terminals of the MOSFETs Q7 and Q9 is also derived from the RF signal, filtered through resistors R7 and R8, diodes CR7 and CR8, zener CR9 and capacitor C8. A combination of opto-isolators 84 and 86 provides for MOSFETs Q7 and Q9 to be conducting only when one of the other MOSFET pairs is disabled.

By deriving the gate bias signals from the RF signal to be supplied to the antennas, complete isolation of the antennas and the associated switches is accomplished, thereby reducing component count, and eliminating the need to reference the antennas and the associated switches to the transmit circuit power supply.

Although a switching arrangement for only two antennas is shown in FIG. 8, it will be appreciated that the four antenna embodiment of FIG. 6 can be implemented in a similar manner.

In each of the embodiments described up to this point, a step-down transformer 34 has been provided at the transmitter side of the multiplexing circuit 32. However, it is contemplated to replace the step-down transformer with a suitable impedance-matching network.

Various other changes in the foregoing apparatus and modifications in the described practices may be introduced without departing from the invention. The particularly preferred methods and apparatus are thus intended in an illustrative and not limiting sense. The true spirit and scope of the invention is set forth in the following claims.

What is claimed is:

1. A transmitter for an electronic article surveillance system, comprising:

a transmit circuit for generating a transmit signal;

antenna means for receiving the transmit signal generated by the transmit circuit and for radiating the transmit signal into an interrogation zone as an interrogation signal, said antenna means including a first antenna and a second antenna; and connecting means for transmitting the transmit signal from the transmit circuit to the antenna means, the connecting means including first coupling means for coupling the connecting means to the transmit circuit, second coupling means for coupling the connecting means to the antenna means, and switch means for selectively uncoupling at least one of said first and second antennas from said transmit circuit, the first coupling means having a first impedance and the second coupling means having a second impedance that is matched to said first impedance.

2. A transmitter according to claim 1, wherein said first antenna includes a first antenna coil for radiating the transmit signal in the interrogation zone, said second antenna includes a second antenna coil for radiating the transmit signal in the interrogation zone, said second coupling means of said connecting means includes a first winding inductively coupled to said first antenna coil and a second winding inductively coupled to said second antenna coil, and said switch means of said connecting means includes a first switch connected across said first winding for selectively short-circuiting said first winding, and a second switch connected across said second winding for selectively short-circuiting said second winding.

3. A transmitter according to claim 2, wherein said antenna means further includes a third antenna and a fourth antenna.

4. A transmitter according to claim 1, wherein said second coupling means includes a first transformer for coupling the connecting means to said first antenna, and a second transformer for coupling the connecting means to said second antenna.

5. A transmitter according to claim 4, wherein said switch means includes a first switch connected across a winding of said first transformer for selectively short-circuiting said winding of said first transformer, and a second switch connected across a winding of said second transformer for selectively short-circuiting said winding of said second transformer.

6. A transmitter for an electronic article surveillance system, comprising:

a transmit circuit for generating a transmit signal;

antenna means for receiving the transmit signal generated by the transmit circuit and for radiating the transmit signal into an interrogation zone as an interrogation signal; and connecting means for transmitting the transmit signal from the transmit circuit to the antenna means, the connecting means including first coupling means for coupling the connecting means to the transmit circuit, and second coupling means for coupling the connecting means to the antenna means, the first coupling means having a first impedance and the second coupling means having a second impedance that is matched to said first impedance, wherein said first coupling means is a transformer having a primary winding and a secondary winding, said secondary winding having said first impedance.

7. Apparatus for interconnecting a transmitter and a plurality of antennas, the transmitter having first and second terminals, the plurality of antennas including a first antenna having a first antenna coil, and a second antenna having a second antenna coil, the apparatus comprising:

a step-down transformer including a primary winding, connected across said first and second terminals of said transmitter, and a secondary winding;

a first winding positioned for inductively coupling with said first antenna coil of said first antenna;

a second winding positioned for inductively coupling with said second antenna coil of said second antenna;

a first switch;

means for forming a series loop connection which includes said first winding, said second winding, said first switch, and said secondary winding of said transformer, said first switch arranged to selectively open-circuit said series loop connection;

a second switch connected across said second winding for selectively short-circuiting said second winding; and a third switch connected across said first winding for selectively short-circuiting said first winding.

8. Apparatus according to claim 7, wherein said plurality of antennas includes a third antenna having a third antenna coil and a fourth antenna having a fourth antenna coil, and further comprising:

a third winding positioned for inductively coupling with said third antenna coil of said third antenna;

a fourth switch connected across said third winding for selectively short-circuiting said third winding;

a fourth winding positioned for inductively coupling with said fourth antenna coil of said fourth antenna;

a fifth switch connected across said fourth winding for selectively short-circuiting said fourth winding;

a sixth switch; and means for forming a series loop connection which includes said third winding, said fourth winding, said sixth switch, and said secondary winding of said transformer;

said series loop connection which includes said third and fourth windings being arranged in parallel with said series loop connection which includes said first and second windings;

said sixth switch being arranged to selectively open-circuit said series loop connection which includes said third and fourth windings.

9. Apparatus according to claim 7, wherein each of said first, second and third switches includes at least one field effect transistor.

10. Apparatus according to claim 9, wherein each of said first, second and third switches includes a stacked pair of MOSFETs.

11. A method of selectively energizing one of a plurality of antennas to radiate a signal generated by a transmitter circuit, each of said plurality of antennas having a respective antenna coil, the method comprising the steps of:

providing a plurality of windings connected in series, each of said windings corresponding to, and inductively coupled with, a respective one of said antenna coils, said series-connected windings being coupled to said transmitter circuit; and short-circuiting all but one of said windings to select for energizing the antenna coil corresponding to said one of said windings.

12. A method according to claim 11, further comprising the steps of:

providing a switch connected in series with said windings; and selectively opening said switch to uncouple all of said antennas from said transmitter circuit.

13. A method according to claim 11, wherein said plurality of antennas includes four antennas.

14. Apparatus for interconnecting a transmitter and a plurality of antennas, the transmitter having first and second terminals, the plurality of antennas including a first antenna having a first antenna coil, and a second antenna having a second antenna coil, the apparatus comprising:

a first winding positioned for inductively coupling with said first antenna coil of said first antenna;

a second winding positioned for inductively coupling with said second antenna coil of said second antenna;

a first switch;

means for forming a series connection of said first winding, said second winding and said first switch;

means for coupling said series connection of said first winding, said second winding and said first switch to said transmitter;

a second switch connected across said second winding for selectively short-circuiting said second winding; and a third switch connected across said first winding for selectively short-circuiting said first winding.

15. Apparatus according to claim 14, wherein said means for coupling includes a transformer for stepping down a level of a signal output from said transmitter to form a signal to be applied across said series connection.

16. Apparatus according to claim 14, wherein each of said first, second and third switches includes at least one field effect transistor.

17. Apparatus according to claim 16, wherein each of said first, second and third switches includes a stacked pair of MOSFETs.

18. An antenna multiplexer for supplying a radio frequency signal to a selected one of a plurality of antennas, comprising:

a plurality of transistor switches, for selecting respective ones of said plurality of antennas and each having a gate terminal;

means for filtering said radio frequency signal to form a bias signal; and means for selectively coupling said bias signal to the respective gate terminals of said transistor switches.

19. An antenna multiplexer according to claim 18, wherein said plurality of transistor switches includes a plurality of stacked pairs of field effect transistors (FETs), each of said pairs of FETs corresponding to a respective one of said antennas.

20. An antenna multiplexer according to claim 19, wherein said bias signal is selectively coupled to each pair of FETs for de-selecting the antenna which corresponds to the respective pair of FETS.

21. An antenna multiplexer according to claim 20, wherein said means for selectively coupling includes a plurality of opto-isolators, each for controlling coupling of said bias signal to a respective one of said pairs of FETs.

* * * * *